US009367015B2

(12) United States Patent
Doyo et al.

(10) Patent No.: US 9,367,015 B2
(45) Date of Patent: Jun. 14, 2016

(54) SHEET FEEDER AND IMAGE FORMING APPARATUS

(71) Applicant: KYOCERA Document Solutions Inc., Osaka (JP)

(72) Inventors: Hideaki Doyo, Osaka (JP); Toshio Hori, Osaka (JP); Hiroaki Takai, Osaka (JP); Yoshio Sugishima, Osaka (JP); Takehiro Sato, Osaka (JP); Noriko Masuta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/598,486

(22) Filed: Jan. 16, 2015

(65) Prior Publication Data

US 2015/0205245 A1 Jul. 23, 2015

(30) Foreign Application Priority Data

Jan. 23, 2014 (JP) ..... 2014-009990

(51) Int. Cl.

| | |
|---|---|
| ***B65H 3/00*** | (2006.01) |
| ***G03G 15/00*** | (2006.01) |
| *B65H 1/26* | (2006.01) |

(52) U.S. Cl.

CPC ..... *G03G 15/6552* (2013.01); *B65H 1/266* (2013.01); *B65H 2301/517* (2013.01); *B65H 2301/5143* (2013.01); *B65H 2405/111* (2013.01); *B65H 2407/311* (2013.01)

(58) Field of Classification Search

CPC ..... B65H 2301/5143; B65H 2407/311; B41J 29/377

See application file for complete search history.

(56) References Cited

U.S. PATENT DOCUMENTS

| | | | | |
|---|---|---|---|---|
| 2003/0156871 | A1* | 8/2003 | Carlson et al. | 399/390 |
| 2010/0059929 | A1* | 3/2010 | Okumura | 271/117 |
| 2012/0134708 | A1* | 5/2012 | Asaka | G03G 21/203 399/97 |

FOREIGN PATENT DOCUMENTS

| | | |
|---|---|---|
| JP | H05-338833 A | 12/1993 |
| JP | H09-150978 A | 6/1997 |

* cited by examiner

*Primary Examiner* — John Fitzgerald
*Assistant Examiner* — John M Royston
(74) *Attorney, Agent, or Firm* — Studebaker & Brackett PC

(57) ABSTRACT

A sheet feeder includes a sheet feeding cassette stored in a cassette storage part, a heater and flow regulating plates. A first gap is formed between the bottom plate of the sheet feeding cassette and a bottom portion of the cassette storage part, and having an air intake port. A second gap is formed between the side plate of the sheet feeding cassette and a side portion of the cassette storage part and has a vent port communicating with the first gap and the sheet storing part. The flow regulating plates are disposed in the first gap so as to form a duct together with the sheet feeding cassette and the cassette storage part. Air flow is generated such that air is supplied from the air intake port into the first gap, is heated, rises through the second gap from the vent port, and flows to the sheet storing part.

18 Claims, 10 Drawing Sheets

SHEET FEEDER AND IMAGE FORMING APPARATUS

INCORPORATION BY REFERENCE

This application is based on and claims the benefit of priority from Japanese Patent application No. 2014-009990 filed on Jan. 23, 2014, the entire contents of which are incorporated herein by reference.

BACKGROUND

The present disclosure relates to a sheet feeder and to an image forming apparatus including the sheet feeder.

In an image forming apparatus, a sheet on which an image is to be formed is stored in a sheet feeding cassette of a sheet feeder. If the sheet absorbs moisture in a high humidity environment, there is a possibility of causing a defective image or jamming due to conveyance failure. Thus, there is an image forming apparatus provided with a dehumidifying heater arranged under the sheet feeding cassette.

However, because there are many gaps around the sheet feeding cassette, warm air generated from the dehumidifying heater may not be fully supplied to the sheet feeding cassette, causing such possibility that dehumidifying effect is exerted only on a vicinity of the dehumidifying heater or that the vicinity of the dehumidifying heater is locally heated and deformed.

Then, there is a sheet feeder provided with a sheet feeding cassette having a bottom face with a large number of vent holes to supply warm air into the sheet feeding cassette through the vent holes. There is also such a sheet feeder in which dehumidifying heaters are disposed corresponding to a peripheral of a sheet by considering a tendency that the sheet stored in the sheet feeding cassette has higher moisture content at a peripheral thereof more than a center thereof.

However, in the sheet feeder provided with the sheet feeding cassette having the bottom surface with the large number of vent holes, if a large size sheet is stored, the vent holes may be closed by the sheet and therefore enough ventilation cannot be assured. In the sheet feeder in which the dehumidifying heaters are disposed corresponding to the peripheral of the sheet, it is difficult to supply warm air to upper sheet feeding cassettes in a case where a plurality of sheet feeding cassettes is stacked.

Although it is also conceivable to provide a fan to supply warm air to the sheet feeding cassettes, it is desirable not to use the fan as much as possible to cut costs and to decrease noise.

SUMMARY

In accordance with an embodiment of the present invention, a sheet feeder includes a sheet feeding cassette, a cassette storage part, a dehumidifying heater and flow regulating plates. The sheet feeding cassette includes a side plate and a bottom plate and forms a sheet storing part. The cassette storage part is configured to store the sheet feeding cassette. A first gap is formed between the bottom plate of the sheet feeding cassette stored in the cassette storage part and a bottom portion of the cassette storage part, and has an air intake port opened to an outside. A second gap is formed between the side plate of the sheet feeding cassette stored in the cassette storage part and a side portion of the cassette storage part. The second gap has a vent port communicating with the first gap and communicating with the sheet storing part. The dehumidifying heater is disposed in the first gap and heating air in the first gap. The flow regulating plates are disposed in the first gap so as to interpose the dehumidifying heater from both sides in a horizontal direction. The flow regulating plates is configured to form a duct together with the sheet feeding cassette and the cassette storage part. In the duct, air flow is generated such that air is supplied from the air intake port into the first gap, is heated up by the dehumidifying heater, rises through the second gap from the vent port, and flows to the sheet storing part.

In accordance with an embodiment of the present invention, an image forming apparatus includes a sheet feeder. The sheet feeder has a sheet feeding cassette, a cassette storage part, a dehumidifying heater and flow regulating plates. The sheet feeding cassette includes a side plate and a bottom plate and forms a sheet storing part. The cassette storage part is configured to store the sheet feeding cassette. A first gap is formed between the bottom plate of the sheet feeding cassette stored in the cassette storage part and a bottom portion of the cassette storage part, and has an air intake port opened to an outside. A second gap is formed between the side plate of the sheet feeding cassette stored in the cassette storage part and a side portion of the cassette storage part. The second gap has a vent port communicating with the first gap and communicating with the sheet storing part. The dehumidifying heater is disposed in the first gap and heating air in the first gap. The flow regulating plates are disposed in the first gap so as to interpose the dehumidifying heater from both sides in a horizontal direction. The flow regulating plates is configured to form a duct together with the sheet feeding cassette and the cassette storage part. In the duct, air flow is generated such that air is supplied from the air intake port into the first gap, is heated up by the dehumidifying heater, rises through the second gap from the vent port, and flows to the sheet storing part.

The above and other objects, features, and advantages of the present disclosure will become more apparent from the following description when taken in conjunction with the accompanying drawings in which a preferred embodiment of the present disclosure is shown by way of illustrative example.

BRIEF DESCRIPTION OF THE DRAWINGS

9A is a front section view of the sheet feeder and FIG. 9B is an enlarged section view of a part of the sheet feeder shown in FIG. 9A.

DETAILED DESCRIPTION

In the following, with reference the drawings, an image forming apparatus according to an embodiment of the present disclosure will be described.

Figure 1:
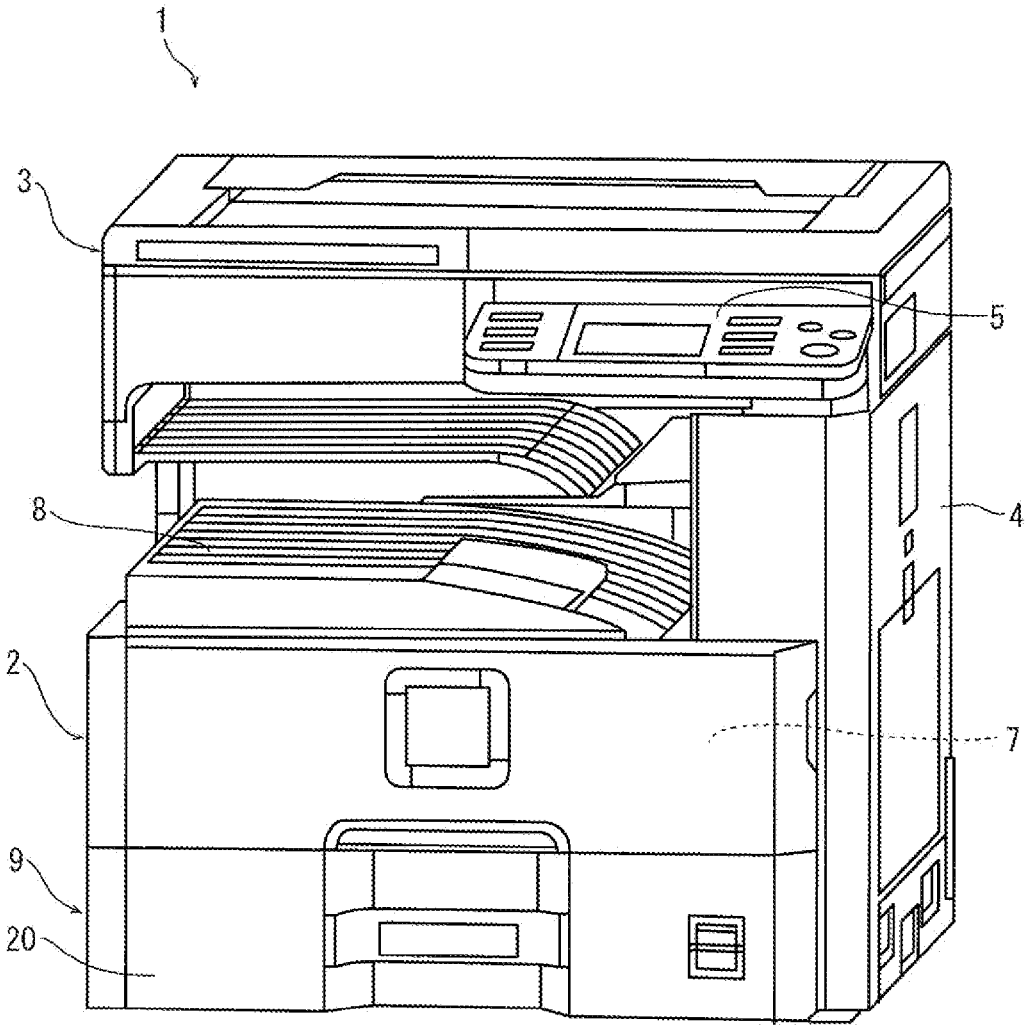
FIG. 1 is a perspective view showing an entire structure of a printer according to a first embodiment of the present disclosure.

First, with reference to FIG. 1, an entire structure of an electrographic printer 1 (an image forming apparatus) will be described. FIG. 1 is a schematic diagram schematically showing the structure of the printer according to the embodiment of the present disclosure. In the following explanation, a near side on FIG. 1 indicates a front side of the printer 1 and directions orthogonal to the forward and backward directions are set to the left and right directions.

The printer 1 includes an apparatus main body part 2 and an image reading part 3 disposed above the apparatus main body part 2.

The apparatus main body part 2 has a box-like housing 4 which supports an operating panel part 5 operated in a case where various settings are achieved or various functions of copying, facsimile and others are used, an image forming unit 7 storing a known image forming processing unit (not shown), a sheet ejecting unit 8 configured to store a sheet on which an image has been formed, and a sheet feeder 9 configured to feed a sheet on which an image is to be formed.

Figure 2:
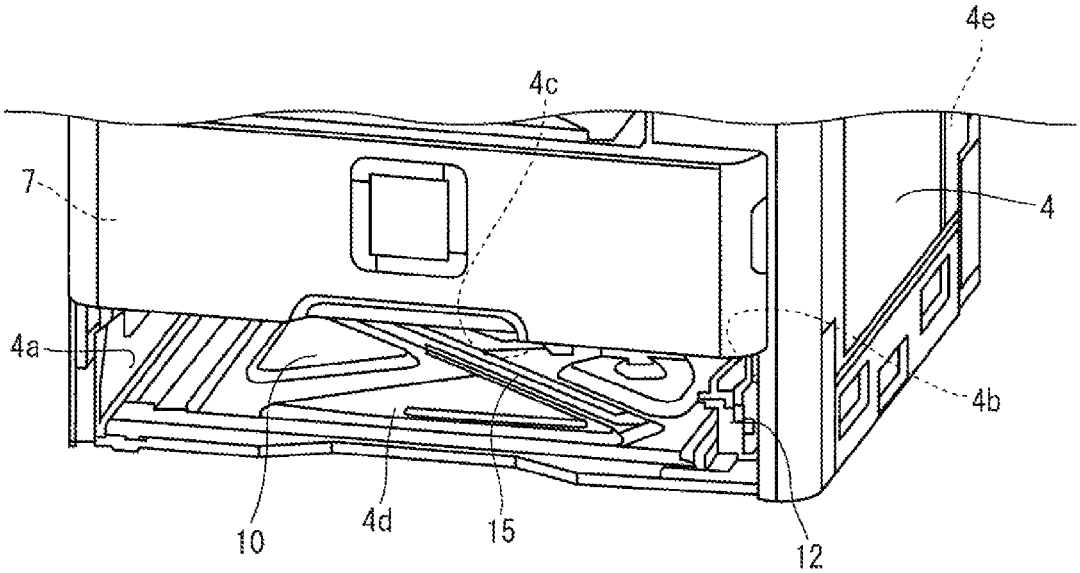
FIG. 2 is a perspective view showing an opening part of a sheet feeder according to the first embodiment of the present disclosure.
Figure 3:
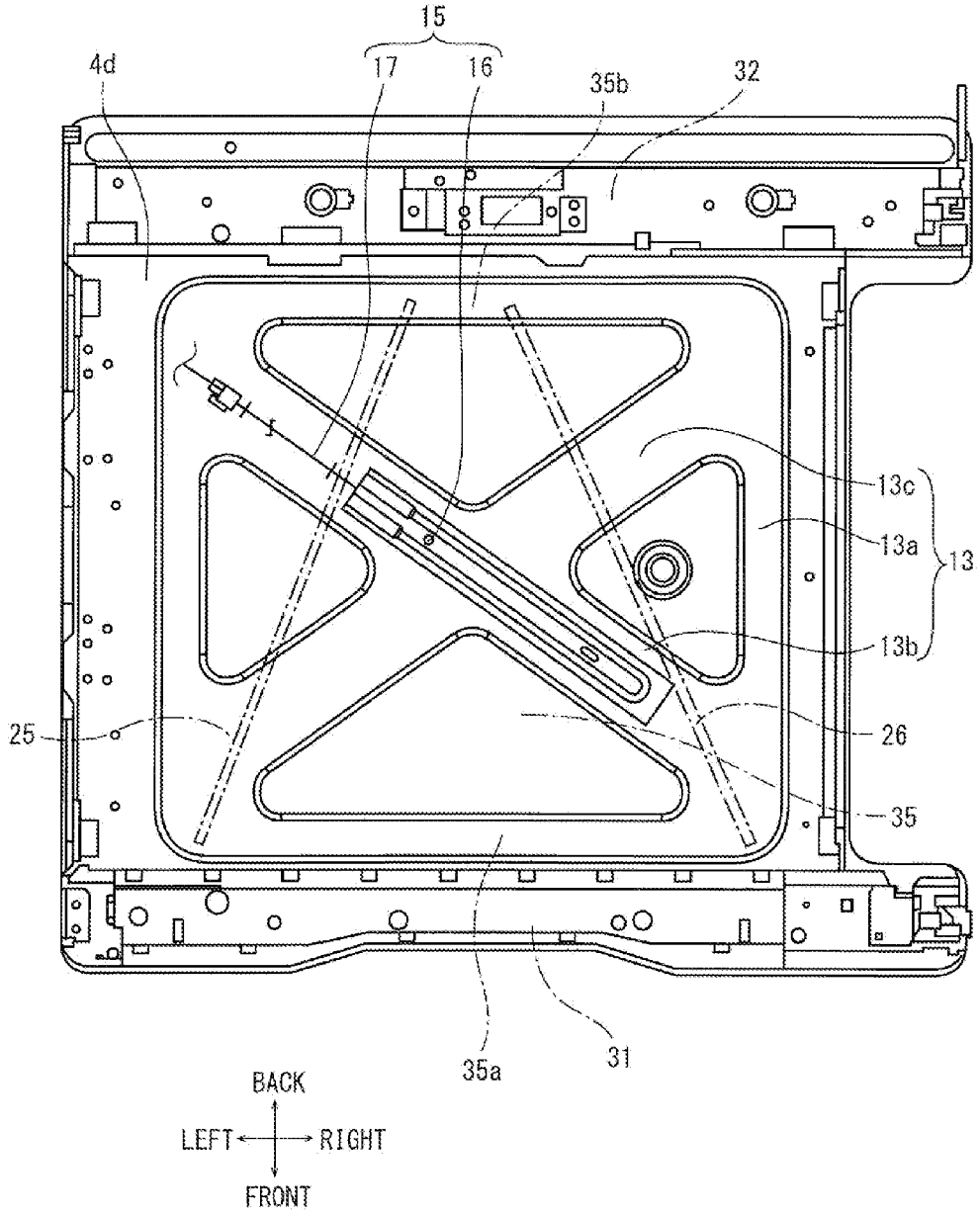
FIG. 3 is a plan view of a bottom plate of a housing of the sheet feeder according to the first embodiment of the present disclosure.
Figure 4:
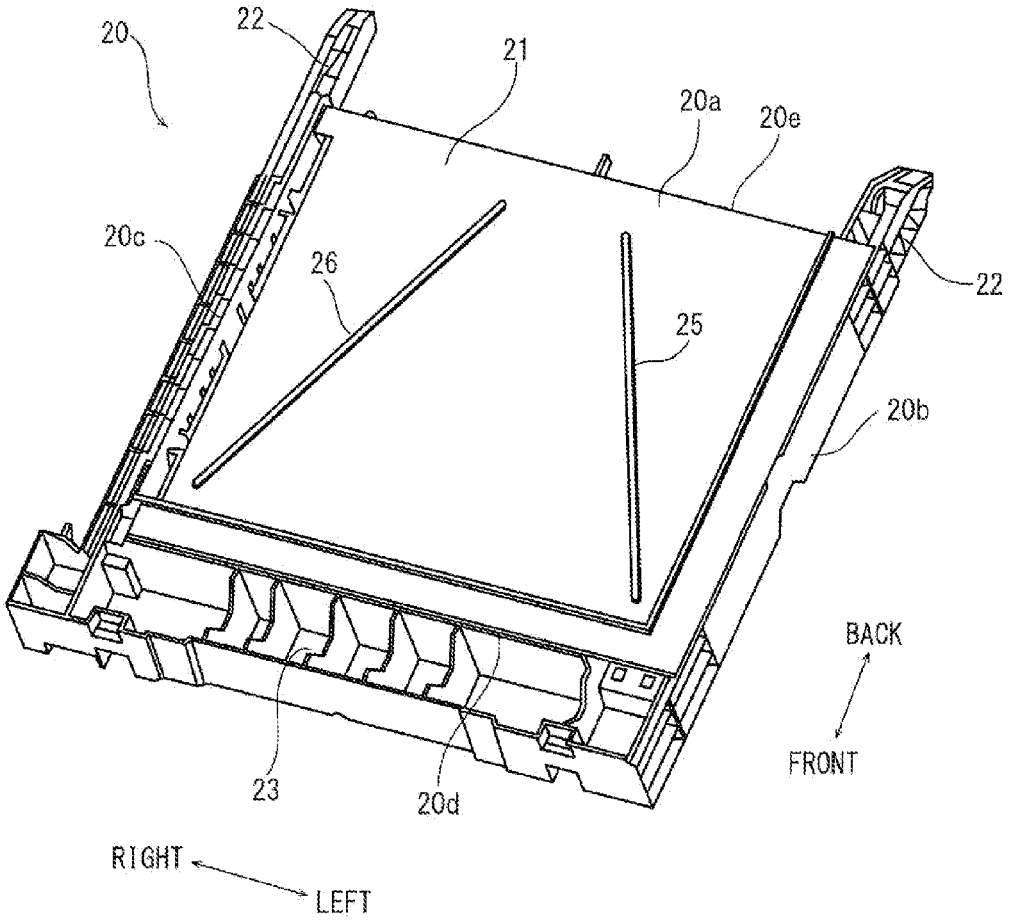
FIG. 4 is a perspective view showing the sheet feeding cassette viewed from below thereof, in the sheet feeder according to the first embodiment of the present disclosure.

With reference to FIGS. 2 through 4, the sheet feeder 9 of the first embodiment will be explained. FIG. 2 is a perspective view showing an opening part of the sheet feeder 9, FIG. 3 is a plan view showing a bottom face of the housing 4, and FIG. 4 is a perspective view showing a sheet feeding cassette 20 viewed from below thereof.

As shown in FIG. 2, the sheet feeder 9 has an opening part 10 (cassette storage part) provided under the image forming unit 7 in the housing 4 and a sheet feeding cassette 20 stored in the opening part 10 so as to be pulled in/out in the forward and backward directions.

The opening part 10 is opened to a front side under the image forming unit 7 and is formed in a flat rectangular parallelepiped space surrounded by left and right side plates 4*a* and 4*b*, an upper plate 4*c*, a bottom plate 4*d* (bottom portion of the cassette storage part) and a back plate 4*e* (side portion of the cassette storage part) of the housing 4. The left and right side plates 4*a* and 4*b*, the upper plate 4*c*, the bottom plate 4*d* and the back plate 4*e* are made of sheet metals, for example.

The inner faces of the left and right side plates 4*a* and 4*b* are provided with rail parts 12 facing to each other, with which the sheet feeding cassette 20 is engaged respectively. The rail parts 12 are disposed in parallel so as to extend in the forward and backward directions.

As shown in FIG. 3, a plurality of shallow reinforcing depressions 13 is formed on an upper face of the bottom plate 4*d* by way of press working or the like. The depressions 13 contain a square outer peripheral part 13*a* and two diagonal line parts 13*b* and 13*c* formed on diagonal lines of the outer peripheral part 13*a*.

A dehumidifying heater 15 is disposed on one diagonal line part 13*b*. As the dehumidifying heater 15, a sheathed heater may be used, for example. The sheathed heater is a heater what a heating element is wrapped by an insulator and is enclosed in a metallic pipe. The dehumidifying heater 15 has a flat and elongated heater body 16 and a wiring part 17 supplying power to the heater body 16. The wiring part 17 extends along an upper face of the diagonal line part 13*b* of the bottom plate 4*d* and is connected to a power supply (not shown) arranged in the apparatus main body part 2. The power supply is also connected to the operating panel part 5 such that temperature of the heater body 16 can be set from the operating panel part 5.

The sheet feeding cassette 20 is formed in a flat box-like shape with an upper face opened and has a bottom plate 20*a*, left and right side plates 20*b* and 20*c*, and front and back side plates 20*d* and 20*e*. As shown in FIG. 4, the sheet feeding cassette 20 includes a sheet storing part 21 surrounded by the bottom plate 20*a*, the left and right side plates 20*b* and 20*c*, and the front and back side plates 20*d* and 20*e*, and slide parts 22 provided on outer faces of the left and right side plates 20*b* and 20*c* and supported by the housing 4.

In the sheet storing part 21, a bottom plate on which a sheet is stacked, a biasing member configured to push up a front end part of the bottom plate, a pair of guide members aligning the sheet to a center in the width direction of the sheet, a positioning member configured to position the sheet in a length direction of the sheet, and others (none of them are shown) are provided. On a front face of the front sideplate 20*d*, a grip part 23 to be gripped in pulling in/out the sheet feeding cassette 20 is provided.

The sheet feeding cassette 20 is provided with first left and right flow regulating plates 25 and 26 on an under face of the bottom plate 20*a* so as to project downward. A front end of the first left flow regulating plate 25 is located around a left corner of the bottom plate 20*a* and a back end thereof is located at a position on a slightly left side from a center of aback edge of the bottom plate 20*a*. A front end of the first right flow regulating plate 26 is located around a right corner of the bottom plate 20*a* and a back end thereof is located at a position on a slightly right side from the center of the back edge of the bottom plate 20*a*. That is, as shown in FIG. 4, the first left and right flow regulating plates 25 and 26 are disposed in a shape of a truncated chevron such that a distance between the first left and right flow regulating plates 25 and 26 becomes wider from the back side toward the front side of the bottom plate 20*a* of the sheet feeding cassette 20.

The first left and right flow regulating plates 25 and 26 may be formed integrally with the sheet feeding cassette 20 so as to project downward from the under face of the bottom plate 20*a* in molding the sheet feeding cassette 20. Alternatively, the first left and right flow regulating plates 25 and 26 may be formed separately and mount them on the under face of the bottom plate 20*a* of the sheet feeding cassette 20 by adhesive or the like.

The right and left slide parts 22 are formed so as to extend in the forward and backward directions on outer faces of the left and right side plates 20*b* and 20*c* of the sheet feeding cassette 20. Each back end of the left and right slide parts 22 projects backward beyond the back side plate 20*e* of the sheet storing part 21.

Figure 5:
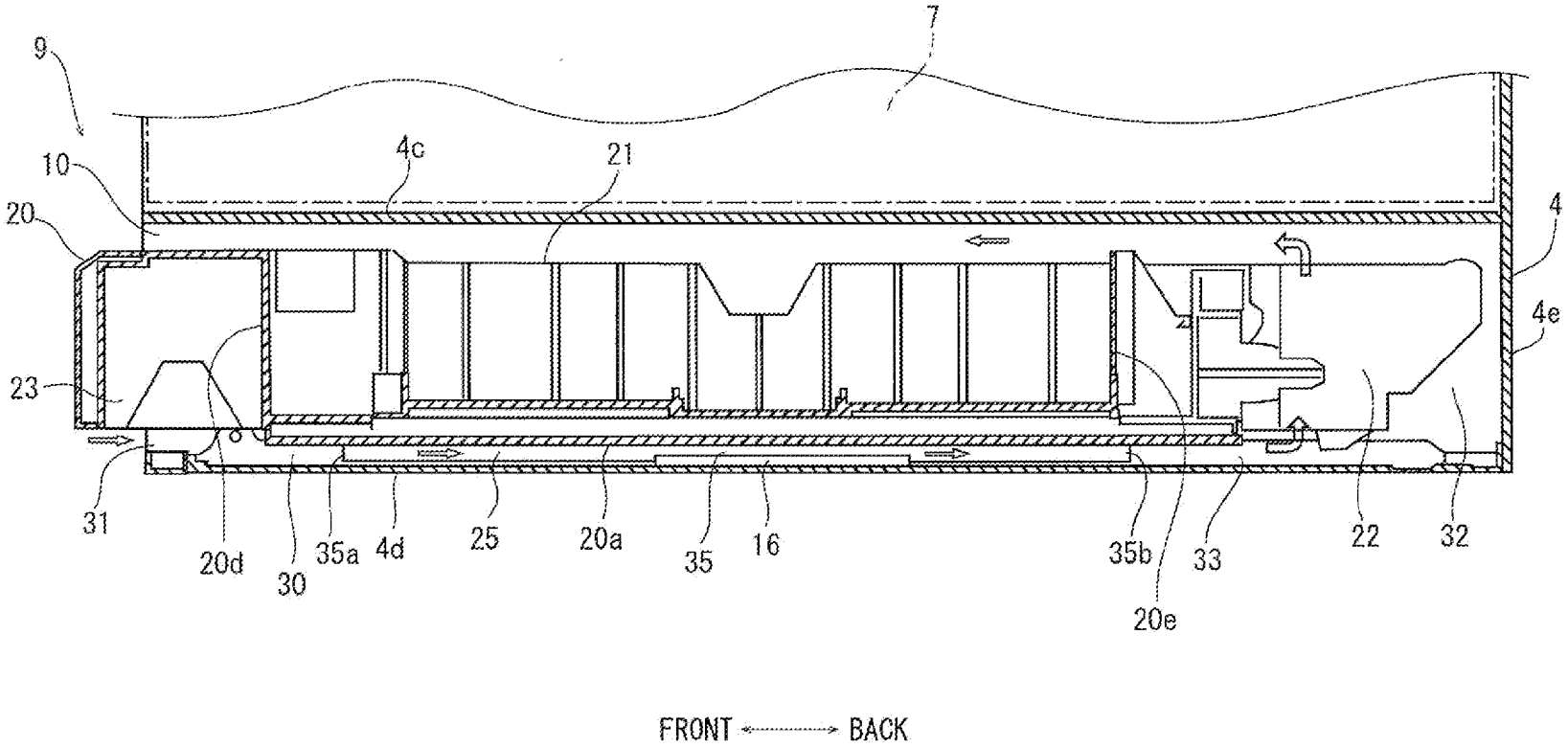
FIG. 5 is a side section view of the sheet feeder of the first embodiment of the present disclosure.

With reference to FIG. 5 and others, the sheet feeding cassette 20 stored in the opening part 10 of the housing 4 will be explained. FIG. 5 is a side sectional view of the sheet feeding cassette 20 stored in the housing 4. The sheet feeding cassette 20 is supported by the opening part 10 of the housing 4 so as to be capable of pulling in/out in the forward and backward directions by engaging the left and right slide parts 22 with the rail parts 12 (see FIG. 2) formed on the left and right side plates 4*a* and 4*b* of the opening part 10 of the housing 4.

In the state in which the sheet feeding cassette 20 is stored in the opening part 10 of the housing 4, a first gap 30 having a predetermined height is formed between the under face of the bottom plate 20*a* of the sheet feeding cassette 20 and the upper face of the bottom plate 4*d* of the housing 4. The first gap 30 communicates with an air intake port 31 opened to the outside in front of the housing 4. Still further, since the slide parts 22 of the sheet feeding cassette 20 project backward from the sheet storing part 21, a second gap 32 is formed between the back side plate 20*e* of the sheet feeding cassette 20 and the back plate 4*e* of the housing 4 by a part projecting from the sheet storing part 21. The second gap 32 communicates with the first gap 30 through a vent port 33 at the back end of the sheet storing part 21 of the sheet feeding cassette 20.

In the first gap 30, a duct 35 extending in the forward and backward directions is formed. The duct 35 is surrounded by the bottom plate 20*a* of the sheet feeding cassette 20 and the bottom plate 4*d* of the housing 4 in the upward and downward directions and by the first left and right flow regulating plates 25 and 26 in the left and right directions. As shown in FIG. 3, since the first left and right flow regulating plates 25 and 26 are disposed on both left and right sides of the heater body 16 of the dehumidifying heater 15 mounted on the upper face of the bottom plate 4*d* of the housing 4, the heater body 16 is stored in the duct 35.

The duct 35 is formed such that an inlet port 35*a* is opened to the air intake port 31 and an outlet port 35*b* thereof is opened to the vent port 33. Thus, in the duct 35, air flow flowing from the inlet port 35*a* on a side of the air intake port 31 toward the outlet port 35*b* on a side of the vent port 33 through the heater body 16 of the dehumidifying heater 15 is generated.

A dehumidifying effect of the dehumidifying heater 15 of the sheet feeder 9 constructed as described above will be explained. When the heater body 16 of the dehumidifying heater 15 is heated up to a predetermined temperature, the heating not only heats the bottom plate 4*d* by the heat transmitting work but also generates air flow indicated by white blanked arrows in FIG. 5. That is, the outside air is taken into the first gap 30 through the air intake port 31, and a part of the intake air is taken into the inlet port 35*a* of the duct 35 and is heated by the heater body 16 of the dehumidifying heater 15 to generate warm air. The warm air flows from the outlet port 35*b* of the duct 35 to the vent port 33, rises through the second gap 32, flows forward along the upper plate 4*c* of the housing 4 and is introduced into a space above the sheet storing part 21 of the sheet feeding cassette 20. The sheet stored in the sheet storing part 21 is dehumidified by the introduced warm air.

In the sheet feeder 9 of the present embodiment, the first left and right flow regulating plates 25 and 26 make it possible to generate the natural air flow in which the warm air flows toward the sheet storing part 21 of the sheet feeding cassette 20 without using a fin and to dehumidify the sheet within the sheet storing part 21.

Still further, since the outlet port 35*b* of the duct 35 is formed on the back side of the sheet feeding cassette 20, the warm air is preferentially supplied to the back side of the sheet feeding cassette 20. In general, the printer 1 is often installed in front of a wall surface in a room. Due to such a situation, in the type of printer 1 in which the sheet feeding cassette 20 is pulled in/out in the forward and backward directions, air hardly flows and moisture is easily filled on the back side (the back side of the printer 1) in the pulling in/out direction. That is, the sheet tends to absorb moisture at the back side of the printer 1. Accordingly, it is possible to dehumidify a readily moisture absorptive part of the sheet firstly by supplying the warm air preferentially to the back side of the printer 1.

Still further, since the duct 35 is formed such that the opening sectional area becomes larger toward the inlet port 35*a* (air intake port 31), it is possible to supply a greater amount of air to the duct 35 and to form active air flow.

Still further, the air intake port 31 communicated with to the inlet port 35*a* of the duct 35 and the vent port 33 communicated with to the outlet port 35*b* are structurally required components provided in the sheet feeder 9 originally. Accordingly, by using the originally provided components, it is not required to add a new component other than the first left and right flow regulating plates 25 and 26.

Still further, since the under face of the bottom plate 20*a* of the sheet feeding cassette 20, as the upper face of the duct 35, is formed continuously with the first left and right flow regulating plates 25 and 26, as the side faces of the duct 35, no gap is formed between the upper face and the side surfaces of the duct 35 and therefore the warm air can be flowed without being lost.

Figure 6:
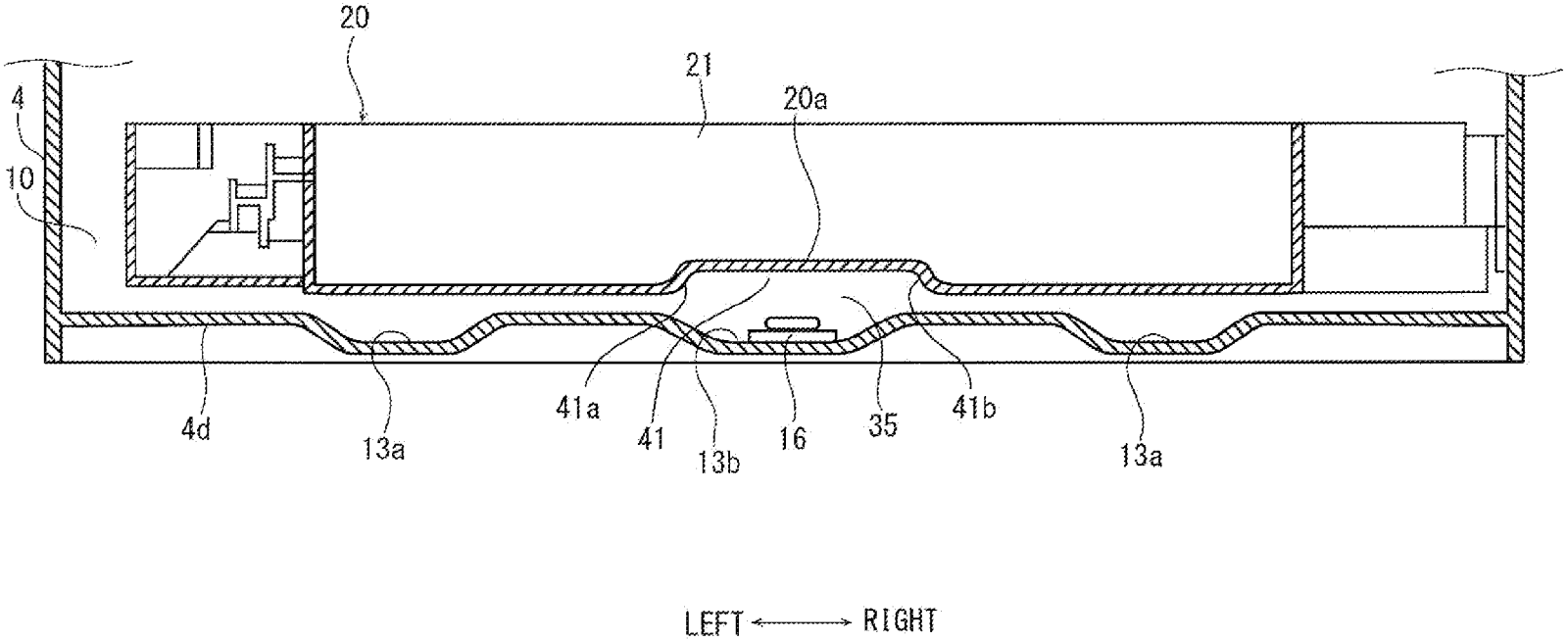
FIG. 6 is a front section view of a sheet feeder according to a second embodiment of the present disclosure.

Next, a sheet feeder of a second embodiment will be explained with reference to FIG. 6. FIG. 6 is a front section view showing the sheet feeding cassette 20. The same components with those of the sheet feeder of the first embodiment will be denoted by the same or corresponding reference numerals with those in FIGS. 4 and 5, and their explanation will be omitted here.

In the sheet feeder 9 of the second embodiment, the sheet feeding cassette 20 is formed with a depression part 41 depressed upward from the under face of the bottom plate 20*a*. The depression part 41 is formed at a center of the bottom plate 20*a* in the left and right directions and has a trapezoidal plan shape of a width becoming narrower toward the back side. The depression part 41 contains a left side surface 41*a* and a right side surface 41*b* facing with each other in the left and right directions. The left side surface 41*a* extends from around the front left corner of the bottom plate 20*a* to a position on a slightly left side from the center of the back edge of the bottom plate 20*a* and the right side surface 41*b* extends from around the front right corner of the bottom plate 20*a* to a position on a slightly right side from the center of the back edge of the bottom plate 20*a*. That is, the left and right side surfaces 41*a* and 41*b* are formed into a truncated chevron shape in plan view.

Still further, the depression part 41 is configured such that a front end thereof opens to the air intake port 31 and a back end thereof opens to the vent port 33. Under the depression part 41, the heater body 16 of the dehumidifying heater 15 is disposed on the bottom plate 4*d* of the housing 4.

Thus, the depression part 41 formed on the bottom plate 20*a* of the sheet feeding cassette 20 and the bottom plate 4*d* of the housing 4 forms the duct 35 extending in the forward and backward directions from the air intake port 31 to the vent port 33. Similarly to the first embodiment described above, in the duct 35, air flow in which warm air heated by the dehumidifying heater 15 flows to the back side of the sheet feeding cassette 20 and rises through the second gap 32 from the vent port 33 is formed. Accordingly, it is possible to obtain a dehumidifying effect similar to that of the first embodiment.

Thus, the flow regulating plates of any shape are applicable as long as they are formed so as to interpose the heater body 16 of the dehumidifying heater 15 from the both sides in the left and right directions and the width between the flow regulating plates becomes narrower from the air intake port 31 to the vent port 33.

Figure 7:
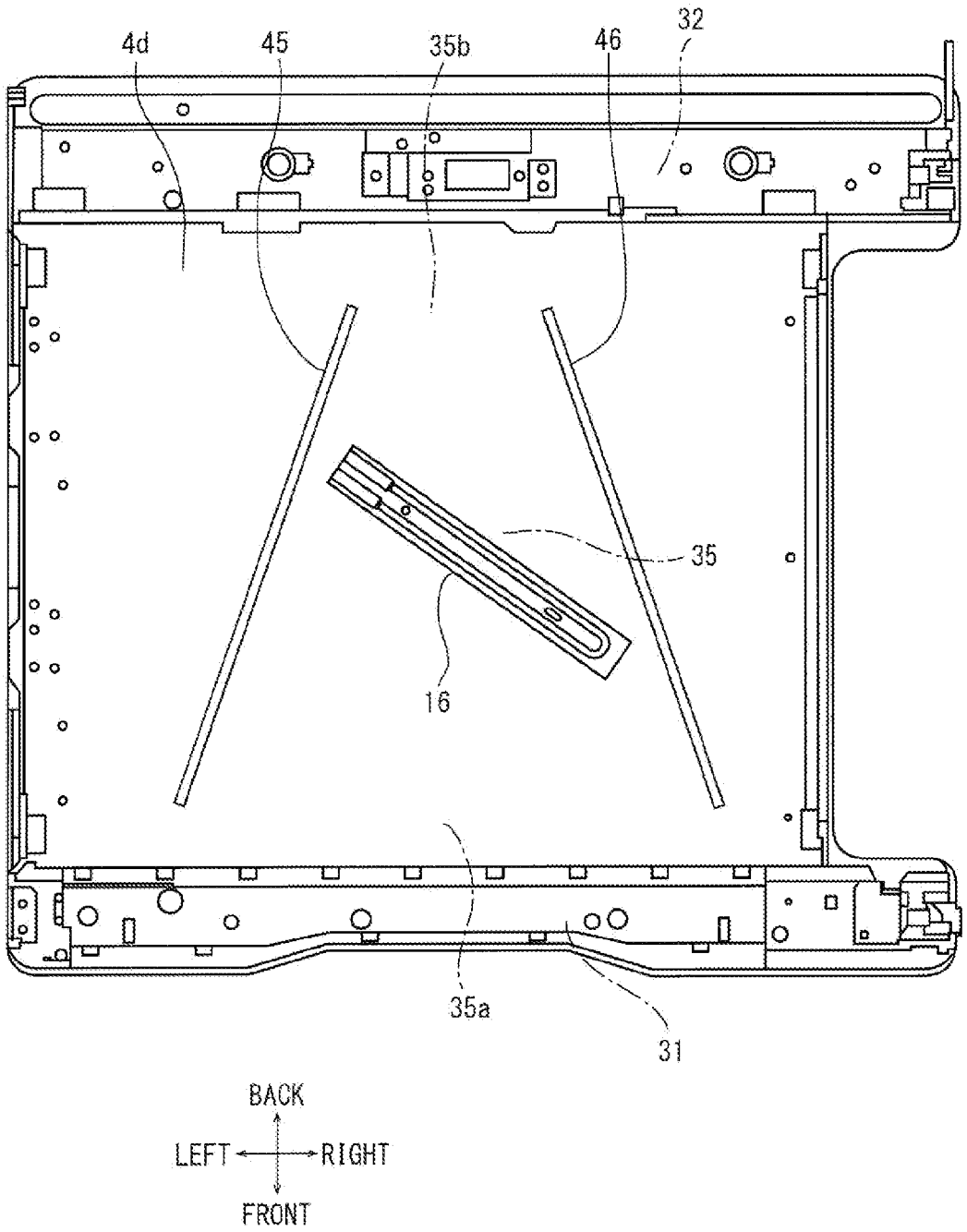
FIG. 7 is a plan view of a bottom plate of a housing of a sheet feeder according to a third embodiment of the present disclosure.

Next, a sheet feeder of a third embodiment will be explained with reference to FIG. 7. FIG. 7 is a plan view of the bottom plate 4*d* of the housing 4.

In the sheet feeder of the third embodiment, the bottom plate 4*d* of the housing 4 is formed with a flat upper face having no reinforcing depressions. The heater body 16 of the dehumidifying heater 15 is disposed near the center of the flat bottom plate 4*d*.

Second left and right flow regulating plates 45 and 46 are formed on the upper face of the bottom plate 4*d* so as to project upward. The second left flow regulating plate 45 extends from around the left corner of the bottom plate 4*d* to a position near the center of the back edge of the bottom plate 4*d* by passing through a left side of the heater body 16 of the dehumidifying heater 15. The second right left flow regulating plate 46 extends from around the right corner of the bottom plate 4*d* to a position near the center of the back edge of the bottom plate 4*d* by passing through a right side of the heater body 16 of the dehumidifying heater 15. Thus, the second left and right flow regulating plates 45 and 46 are disposed in a shape of a truncated chevron in a plan view such that a width between the second left and right flow regulating plates 45 and 46 becomes wider from the back side to the front side.

In the case of the present embodiment, the sheet feeding cassette 20 provided with no flow regulating plate may be used.

In the present embodiment, the second left and right flow regulating plates 45 and 46, the upper face of the bottom plate 4*d* of the housing 4, and the bottom plate 20*a* of the sheet feeding cassette 20 forms the duct 35 extending in the forward and backward directions from the air intake port 31 to the vent port 33 through the heater body 16 of the dehumidifying heater 15. Similarly to the embodiments described above, the duct 35 forms the air flow in which warm air heated by the heater body 16 is introduced to the upper space of the sheet feeding cassette 20.

Still further, since the dehumidifying heater 15 and the second left and right flow regulating plates 45 and 46 are both provided on the bottom plate 4*d* of the housing 4, the dehumidifying heater 15 and the second left and right flow regulating plates 45 and 46 can be positioned readily.

Figure 8:
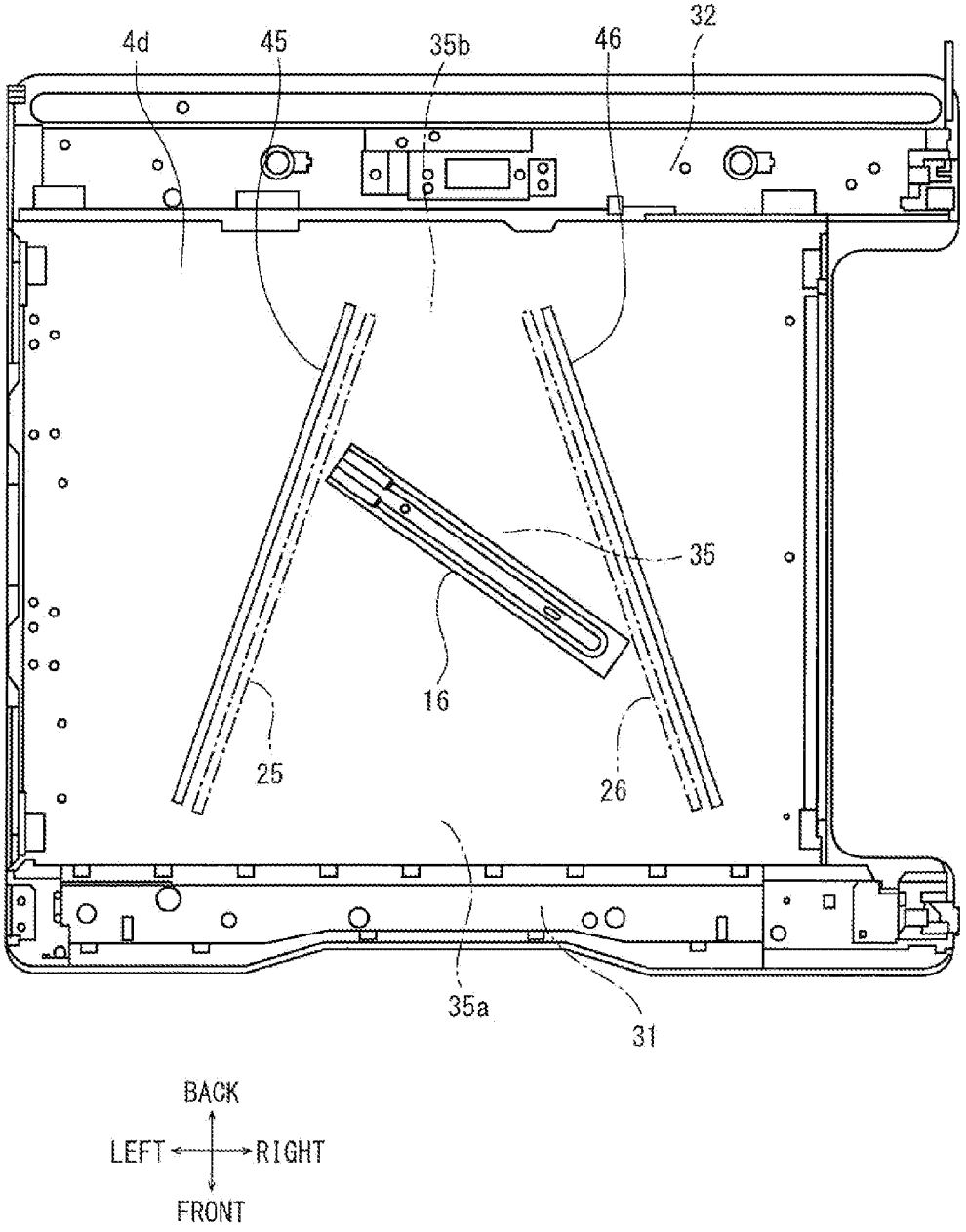
FIG. 8 is a plan view of a bottom plate of a housing of a sheet feeder according to a fourth embodiment of the present disclosure.
Figure 9A:
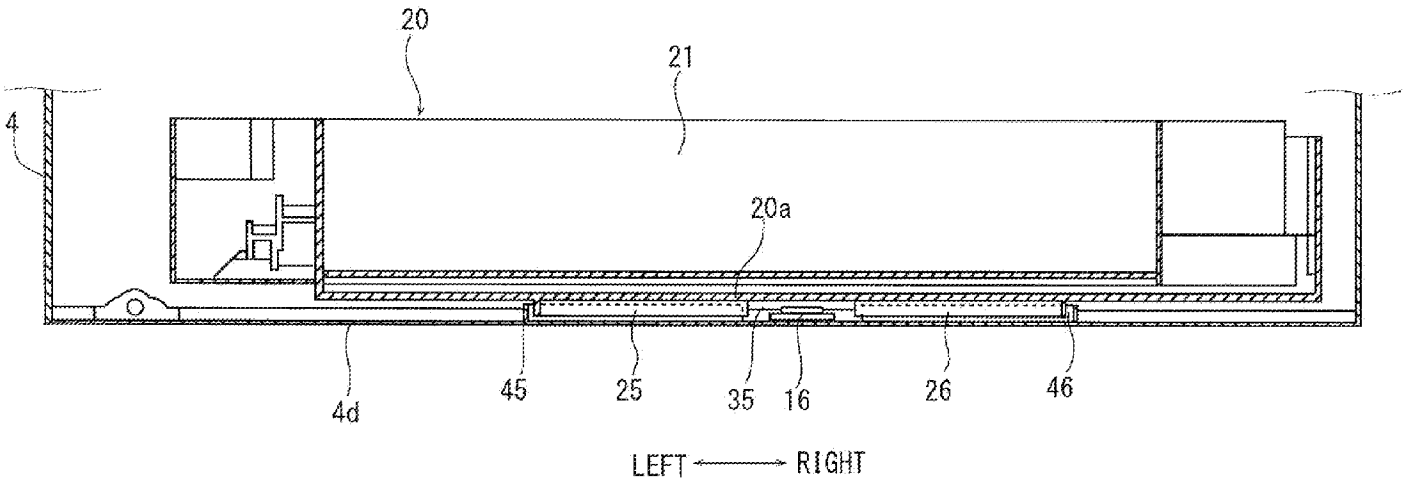
FIG. 9A and FIG. 9B are views of the sheet feeder according to the fourth embodiment of the present disclosure, FIG.

Next, a sheet feeder of a fourth embodiment will be explained with reference to FIGS. 8, 9A, 9B and others. FIG. 8 is a plan view of the bottom plate 4*d* of the housing 4, FIG. 9A is a front section view of the sheet feeder 9, and FIG. 9B is an enlarged view of a part of the sheet feeder 9 in FIG. 9A.

The sheet feeding cassette 20 of the sheet feeder 9 of the present embodiment is provided with the first left and right flow regulating plates 25 and 26 projecting downward from the under face of the bottom plate 20*a* of the sheet feeding cassette 20, as shown in FIG. 4. Furthermore, the housing 4 of the sheet feeder 9 is provided with the second left and right flow regulating plates 45 and 46 projecting upward from the upper face of the bottom plate 4*d* so as to interpose the heater body 16 of the dehumidifying heater 15 between them as shown in FIG. 8. The first left and right flow regulating plates 25 and 26 and the second left and right flow regulating plates 45 and 46 are formed such that the width between the flow regulating plates becomes wider from the back side to the front side.

As shown in FIG. 8, the first left and right flow regulating plates 25 and 26 are disposed respectively inside the second left and right flow regulating plates 45 and 46 in the left and right directions so as to extend along the second left and right flow regulating plates 45 and 46. That is, the first left flow regulating plate 25 is disposed on the right side of the second left flow regulating plate 45 substantially in parallel with the second left flow regulating plate 45, and the first right flow regulating plate 26 is disposed on the left side of the second right flow regulating plate 46 substantially in parallel with the second right flow regulating plate 46.

Figure 9B:
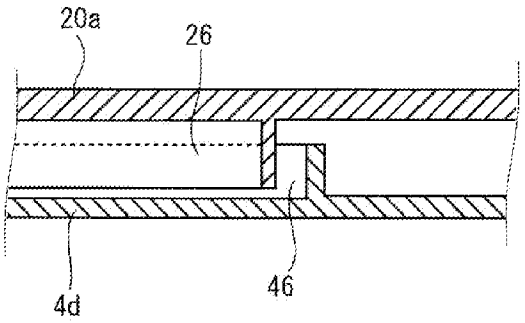

As shown in FIG. 9B, since the first left and right flow regulating plates 25 and 26 project upward and the second left and right flow regulating plates 45 and 46 project downward, the first left and right flow regulating plates 25 and 26 and the second left and right flow regulating plates 45 and 46 are overlapped with each other when viewed horizontally.

In the present embodiment, the first left and right flow regulating plates 25 and 26, the second left and right flow regulating plates 45 and 46, the bottom plate 4*d* of the housing 4, and the upper surface of the bottom plate 20*a* of the sheet feeding cassette 20 form the duct 35 extending in the forward and backward directions from the air intake port 31 to the vent port 33 through the heater body 16 of the dehumidifying heater 15. Similarly to the embodiments described above, the duct 35 forms the air flow in which warm air heated by the heater body 16 flows to the back side of the sheet feeding cassette 20 and rises through the second gap 32 from the vent port 33.

Furthermore, as shown in FIG. 9B, since the both side faces of the duct 35 are formed by the first left and right flow regulating plates 25 and 26 and the second left and right flow regulating plates 45 and 46 projected alternately in the upward and backward directions, the warm air is hardly lost out of the duct 35. It is noted that since the first left and right flow regulating plates 25 and 26 are disposed inside the second left and right flow regulating plates 45 and 46, the first left and right flow regulating plates 25 and 26 will not interfere with the second left and right flow regulating plates 45 and 46 in pulling the sheet feeding cassette 20 out.

In the embodiments described above, although the duct 35 is formed such that the width becomes narrower from the inlet port 35*a* to the outlet port 35*b*, the shape of the duct 35 is not limited to that shape. For instance, the duct 35 may be formed into a shape in which the width becomes narrower from the inlet port 35*a* to the heater body 16 of the dehumidifying heater 15 and the width becomes wider from the heater body 16 to the outlet port 35*b*.

Still further, although the outlet port 35*b* of the duct 35 is disposed at the center part of the back edge of the sheet feeding cassette 20 in the present embodiments, the position of the outlet port 35*b* is not limited to that and the outlet port 35*b* may be disposed corresponding to a part where dehumidification is intensively required. For instance, if a sheet feed roller needs to be dehumidified, the outlet port 35*b* may be disposed also at a position corresponding to the sheet feed roller. In a case where the sheet feed roller is disposed at a position corresponding around a center of a right edge of the sheet feeding cassette 20, the outlet port 35*b* of the duct 35 is disposed around the center of the right edge of the bottom plate 20*a* of the sheet feeding cassette 20 and the duct 35 is formed into a shape extending from the front edge of the bottom plate 20*a* to the right edge.

Figure 10:
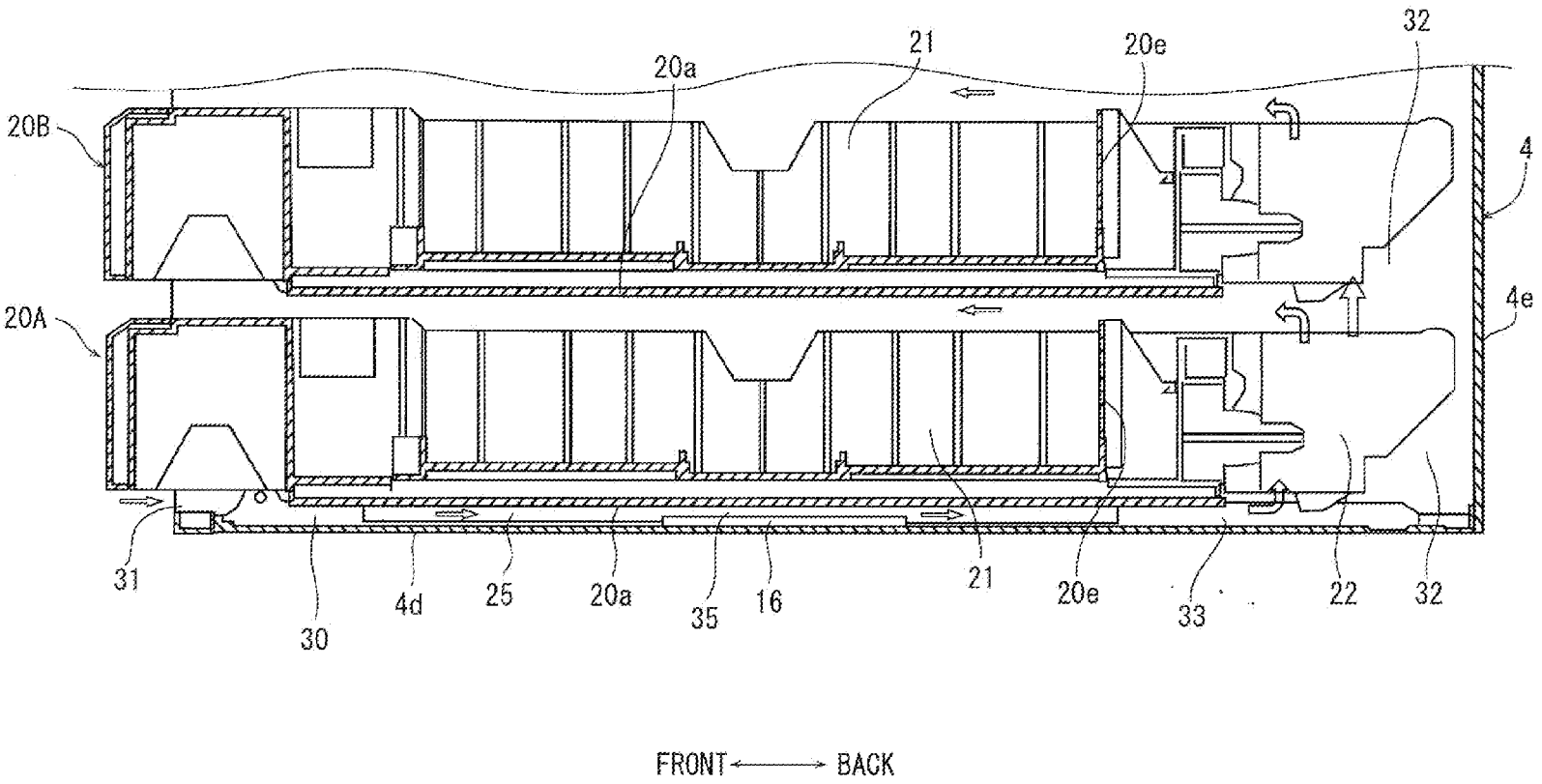
FIG. 10 is a side section view illustrating air flow in a case where a plurality of sheet feeding cassettes is included in the sheet feeder according to the embodiments of the present disclosure.

Still further, while the case where one stage of sheet feeding cassette 20 is stored to the printer 1 has been explained in the embodiments described above, a number of sheet feeding cassette 20 is not limited to one. In a case where two stages of sheet feeding cassette 20 are stored in the printer 1 for example, as shown in FIG. 10, the first gap 30 is formed between the lower feeding cassette 20A which faces to the bottom plate 4*d* of the housing 4 and the bottom plate 4*d* of the housing 4 and the second gap 32 is formed between the sheet feeding cassettes 20A, 20B and the side plate 4*d* of the housing 4. Warm air generated in the first gap 30 flows from the outlet port 35*b* of the duct 35 to the second gap 32, rises through the second gap 32, flows forward along an under face of the bottom plate 20*a* of the upper sheet feeding cassette 20B and is introduced into the sheet storing part 21 of the lower sheet feeding cassette 20A. A sheet in the upper sheet feeding cassette 20B is also dehumidified by the warm air introduced into the sheet storing part 21. In the case where a plurality of sheet feeding cassettes 20 is stored in the printer 1, the first gap 30 is formed between the bottom plate 20*a* of the lowest sheet feeding cassette 20 which faces to the bottom plate 4*d* of the housing 4 and the bottom plate 4*d* of the housing 4 and the second gap 32 is formed between the side plates 20*e* of the respective sheet feeding cassettes 20 and the back plate 4*e* of the housing 4. The second gaps 32 communicate with each other in the upward and downward directions (in a vertical direction). Accordingly, the air flow rising through the second gaps 32 branches toward each of the sheet storing parts 21 of the sheet feeding cassettes 20. Thus, it is possible to supply the warm air to the upper sheet feeding cassette 20 even in the case where the plurality of sheet feeding cassettes 20 is stored in the printer 1.

The present embodiment is also applicable to a sheet feeder including a plurality of stages of sheet feeding cassettes corresponding to various sheet sizes, which is installed in the printer 1 as an option. The dehumidifying heater 15 is disposed in the gap between the bottom surface of the lowest sheet feeding cassette and the housing also in such a sheet feeder.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A sheet feeder comprising:

a sheet feeding cassette including a side plate and a bottom plate and forming a sheet storing part;

a cassette storage part configured to store the sheet feeding cassette;

a first gap formed between the bottom plate of the sheet feeding cassette stored in the cassette storage part and a bottom portion of the cassette storage part, and having an air intake port opened to an outside;

a second gap formed between the side plate of the sheet feeding cassette stored in the cassette storage part and a side portion of the cassette storage part, the second gap having a vent port communicating with the first gap and communicating with the sheet storing part to thereby allow air flow between the first gap and the sheet storing part;

a dehumidifying heater disposed in the first gap, having a flat and elongated heater body extending along an upper face of the bottom plate and a wiring part supplying power to the heater body and heating air in the first gap; and flow regulating plates disposed in the first gap on both sides of the dehumidifying heater in a horizontal direction;

wherein the flow regulating plates is configured to form a duct together with the sheet feeding cassette and the cassette storage part, in which air flow is generated in the duct such that air is supplied from the air intake port into the first gap, is heated up by the dehumidifying heater, rises through the second gap from the vent hole, and flows to the sheet storing part.

2. The sheet feeder according to claim 1, wherein the flow regulating plates are formed such that an opening area of the duct becomes larger toward the air intake port on an upstream side from the dehumidifying heater in the air flow direction.

3. The sheet feeder according to claim 1, wherein the sheet feeding cassette is supported to the cassette storage part so as to be pulled in/out in forward and backward directions, and the air intake port is formed at the front end of the cassette storage part and the vent hole is formed at the back end of the cassette storage part.

4. The sheet feeder according to claim 1, wherein the flow regulating plates are formed so as to project downward from an under face of the bottom plate of the sheet feeding cassette.

5. The sheet feeder according to claim 1, wherein the bottom plate of the sheet feeding cassette is provided with a depression part depressed upward from an under face of the bottom plate, the dehumidifying heater is disposed in the depression part and opposite side faces of the depression part form the flow regulating plates.

6. The sheet feeder according to claim 1, wherein the flow regulating plates are formed so as to project upward from the bottom portion of the cassette storage part facing to the under face of the bottom plate of the sheet feeding cassette.

7. The sheet feeder according to claim 1, wherein the flow regulating plates include first flow regulating plates formed so as to project downward from the under face of the bottom plate of the sheet feeding cassette and second flow regulating plates formed so as to project upward from the bottom portion of the cassette storage part facing to the bottom plate of the sheet feeding cassette so as to extend along the first flow regulating plates, in which the first and second flow regulating plates are formed so as to be overlapped with each other viewed from a horizontal direction.

8. The sheet feeder according to claim 1, comprising a plurality of sheet feeding cassettes arrayed in a vertical direction, the first gap formed between the bottom plate of the sheet feeding cassette facing to the bottom portion of the cassette storage part and the bottom portion of the cassette storage part; and second gaps formed between the side plate of the respective sheet feeding cassette and the side portion of the cassette storage part and being in communication with each other in the vertical direction;

wherein air flow rising through the second gaps branches toward each of the sheet storing part of the sheet feeding cassette.

9. The sheet feeder according to claim 2, wherein the flow regulating plates are formed such that an opening area of the duct becomes narrower toward the vent hole on a downstream side from the dehumidifying heater in the air flow direction.

10. An image forming apparatus comprising a sheet feeder:

wherein the sheet feeder includes:

a sheet feeding cassette including a side plate and a bottom plate and forming a sheet storing part;

a cassette storage part configured to store the sheet feeding cassette;

a first gap formed between the bottom plate of the sheet feeding cassette stored in the cassette storage part and a bottom portion of the cassette storage part, and having an air intake port opened to an outside;

a second gap formed between the side plate of the sheet feeding cassette stored in the cassette storage part and a side portion of the cassette storage part, the second gap having a vent hole communicating with the first gap and communicating with the sheet storing part to thereby allow air flow between the first gap and the sheet storing part;

a dehumidifying heater disposed in the first gap, having a flat and elongated heater body extending along an upper face of the bottom plate and a wiring part supplying power to the heater body and heating air in the first gap; and flow regulating plates disposed in the first gap so on both sides of the dehumidifying heater in a horizontal direction;

wherein the flow regulating plates is configured to form a duct together with the sheet feeding cassette and the cassette storage part, in which air flow is generated in the duct such that air is supplied from the air intake port into the first gap, is heated up by the dehumidifying heater, rises through the second gap from the vent hole, and flows to the sheet storing part.

11. The image forming apparatus according to claim 10, wherein the flow regulating plates are formed such that an opening area of the duct becomes larger toward the air intake port on an upstream side from the dehumidifying heater in the air flow direction.

12. The image forming apparatus according to claim 10, wherein the sheet feeding cassette is supported to the cassette storage part so as to be pulled in/out in forward and backward directions, and the air intake port is formed at the front end of the cassette storage part and the vent hole is formed at the back end of the cassette storage part.

13. The image forming apparatus according to claim 10, wherein the flow regulating plates are formed so as to project downward from an under face of the bottom plate of the sheet feeding cassette.

14. The image forming apparatus according to claim 10, wherein the bottom plate of the sheet feeding cassette is provided with a depression part depressed upward from an under face of the bottom plate, the dehumidifying heater is disposed in the depression part and opposite side faces of the depression part form the flow regulating plates.

15. The image forming apparatus according to claim 10, wherein the flow regulating plates are formed so as to project upward from the bottom portion of the cassette storage part facing to the under face of the bottom plate of the sheet feeding cassette.

16. The image forming apparatus according to claim 10, wherein the flow regulating plates include first flow regulating plates formed so as to project downward from the under face of the bottom plate of the sheet feeding cassette and second flow regulating plates formed so as to project upward from the bottom portion of the cassette storage part facing to the bottom plate of the sheet feeding cassette so as to extend along the first flow regulating plates, in which the first and second flow regulating plates are formed so as to be overlapped with each other viewed from a horizontal direction.

17. The image forming apparatus according to claim 10, comprising a plurality of sheet feeding cassettes arrayed in a vertical direction, the first gap formed between the bottom plate of the sheet feeding cassette facing to the bottom portion of the cassette storage part and the bottom portion of the cassette storage part; and second gaps formed between the side plate of the respective sheet feeding cassette and the side portion of the cassette storage part and being in communication with each other in the vertical direction;

wherein air flow rising through the second gaps branches toward each of the sheet storing part of the sheet feeding cassette.

18. The image forming apparatus according to claim 11, wherein the flow regulating plates are formed such that an opening area of the duct becomes narrower toward the vent hole on a downstream side from the dehumidifying heater in the air flow direction.

* * * * *